US005562133A

United States Patent [19]

Mitchell

[11] Patent Number: 5,562,133

[45] **Date of Patent: *Oct. 8, 1996**

[54] FUEL DISPENSING NOZZLE

[75] Inventor: Thomas O. Mitchell, St. Louis, Mo.

[73] Assignee: Hiesky Corporation, Pacific, Mo.

[ * ] Notice: The term of this patent shall not extend beyond the expiration date of Pat. No. 5,476,125.

[21] Appl. No.: 315,758

[22] Filed: Sep. 30, 1994

Related U.S. Application Data

[63] Continuation-in-part of Ser. No. 264,966, Jun. 24, 1994, Pat. No. 5,476,125.

[51] Int. Cl.[6] ..... B65B 31/00

[52] U.S. Cl. ..... 141/206; 141/59; 141/308; 141/392; 141/DIG. 1

[58] Field of Search ..... 141/206–229, 141/392, DIG. 1, 302, 307, 308, 98, 59, 198, 94, 96; 251/65; 137/522; 220/86.2

[56] References Cited

U.S. PATENT DOCUMENTS

| | | | |
|---|---|---|---|
| 3,148,713 | 9/1964 | Jones, Jr. | 141/DIG. 1 |
| 3,603,359 | 9/1971 | Belue | 141/208 |
| 4,058,147 | 11/1977 | Stary et al. | 141/45 |
| 4,068,687 | 1/1978 | Long | 141/59 |
| 4,351,375 | 9/1982 | Polson | 141/98 |
| 4,429,725 | 2/1984 | Walker et al. | 141/59 |
| 4,649,970 | 3/1987 | Bower et al. | 141/302 |
| 4,809,753 | 3/1989 | Fink, Jr. | 141/206 |
| 5,052,429 | 10/1991 | Yoo | 251/65 |

*Primary Examiner*—Henry J. Recla
*Assistant Examiner*—Steven O. Douglas
*Attorney, Agent, or Firm*—Paul M. Denk

[57] ABSTRACT

A vacuum assist nozzle with a vapor recovery system is provided with an automatic vapor return shut-off mechanism to turn off or disable the nozzle's vapor recovery system when the nozzle is placed in the fill pipe of a vehicle having an on-board vapor recovery system. The nozzle includes a diaphragm valve placed in the nozzle's vapor flow path. The diaphragm nozzle control chamber is placed in communication with the vapor flow path. A vent tube, which forms the vapor flow path in the spout, includes a tip valve at the end thereof. The tip valve is magnetically operated, and is responsive to the presence of a magnetic field in the vehicle's fill neck, to enable or disable the vapor recovery system of the nozzle.

9 Claims, 3 Drawing Sheets

FUEL DISPENSING NOZZLE

This application is a continuation-in-part of the application having Ser. No. 08/264,966, now U.S. Pat. No. 5,476,125, filed on Jun. 24, 1994, entitled "Vapor Recovery Gasoline Dispensing Nozzle," which application is incorporated herein by reference.

BACKGROUND OF THE INVENTION

This invention relates to fuel dispensing nozzles, and in particular, to nozzles which will prevent the activation of vapor recovery when the nozzles are placed in vehicles which burn excess fuel vapors.

Many fuel dispensing nozzles are currently provided with vapor recovery systems to prevent fuel vapors from entering the atmosphere when fuel is dispensed from the nozzle. In these nozzles, the vapors are collected from the vehicle's gas tank and drawn back through the dispensing nozzle by a vacuum to a fuel storage tank. Some vehicles are now being provided with their own vapor recovery systems, generally called on-board vapor recovery. When a vacuum assist dispensing nozzle is used to supply fuel to such a vehicle, the nozzle vacuum assist will draw air through the nozzle, rather than fuel vapors. This air will then be drawn into the fuel storage tank, where it can have undesirable effects, such as vapor growth.

SUMMARY OF THE INVENTION

One object of the present invention is to provide an improved fuel dispensing nozzle. A second object is to provide such a nozzle which can determine if the vehicle is equipped with an on-board vapor recovery system.

A third object is to provide such a nozzle which will disable its own vapor recovery system when it is placed in a vehicle having an on-board vapor recovery system.

Another object is to provide such a nozzle which is reliable and simple to operate.

These and other objects will become apparent to those skilled in the art in light of the following description and accompanying drawings.

Briefly stated, a nozzle assembly for dispensing fuel from a source to a vehicle fuel tank is provided. The nozzle assembly includes a nozzle body defining a body fuel flow path and a body vapor recovery path and a spout connected to the body which provides a spout fuel flow path and a spout vapor recovery path. The spout fuel flow path is in fluid communication with the body fuel flow path and the spout vapor recovery path is in fluid communication with the body vapor recovery path. The spout also includes a vent tube that cooperates with the automatic shut-off mechanism of the nozzle. The vent tube has a tip valve therein operable to open or close the vent tube.

A venturi valve is positioned in the nozzle body fuel flow path. The venturi valve has a valve body, a valve seat, and a valve member being movable between a first, closed position in which it seats against the valve seat to close the venturi valve and a second, open position in which the venturi valve is opened due to the pressure of the fuel and to allow the fuel to be dispensed. The valve member is preferably biased to normally close the venturi valve and is opened by pressure from fuel flowing through the fuel flow path. The venturi valve is closed when fuel flow through the fuel flow path stops.

A diaphragm valve is positioned in the body vapor recovery flow path and is movable between a first position in which the vapor recovery flow path is closed and a second position in which the vapor recovery flow path is opened. The diaphragm valve is normally biased to the first, closed position. It includes a control section having a control port which is in communication with the fuel flow path and is operable, when subject to venturi action, to move the diaphragm valve between its closed and opened positions. The venturi is defined by a partial vacuum path of communication extending between the diaphragm valve control port and the venturi port in the fuel flow path. The venturi creates a vacuum in the path of communication sufficiently strong to move the diaphragm from its closed position to its opened position to allow the recovery of vapors by the vacuum assist method.

The diaphragm valve control port is also in communication with the vent tube to place said diaphragm control section in communication with the atmosphere when said tip valve is opened. Thus, when the tip valve is operated to place said diaphragm control port in communication with said atmosphere, any vacuum operation in the diaphragm control section is prevented, and the diaphragm valve is biased and sustained closed.

The tip valve is positioned in said nozzle and includes a valve body having a port in communication with the diphragm control section via the vent tube and a port in communication with the atmosphere, a valve seat, and a magnetic sensitive valve member or ball sized to close one of the tip valve ports to close said vent tube. The magnetic sensitive valve member is responsive to the absence or presence of a proximate magnetic field to close said tip valve to turn off said vapor recovery system. The nozzle can thus, for example, detect when it is placed in the tank neck of a vehicle having an on-board vapor recovery system. Such a vehicle can be fitted with a magnet in the tank neck. The magnet is positioned at the tank neck or fill pipe and is sufficiently strong to attract the magnetic valve member to unseat the valve member, thereby opening the vent tube. When the vent tube is opened, the vacuum in the diphragm control section will be dissipated and the diphragm valve will close, shutting off the nozzle's vapor recovery system. However, if the nozzle is placed in a vehicle without an on-board vapor recovery system, and thus no magnet is positioned at the fill pipe, the tip valve will function in its normal routine, as known in the art, and be spring biased closed, to maintain the vacuum generated in the diaphragm control section, thereby allowing the routine operation of the nozzle's vapor recovery system. As can be appreciated, the polarities of the magnets can be arranged so that the magnets could be placed in vehicles without on-board vapor recovery systems.

DESCRIPTION OF THE PREFERRED EMBODIMENT

Figure 1:
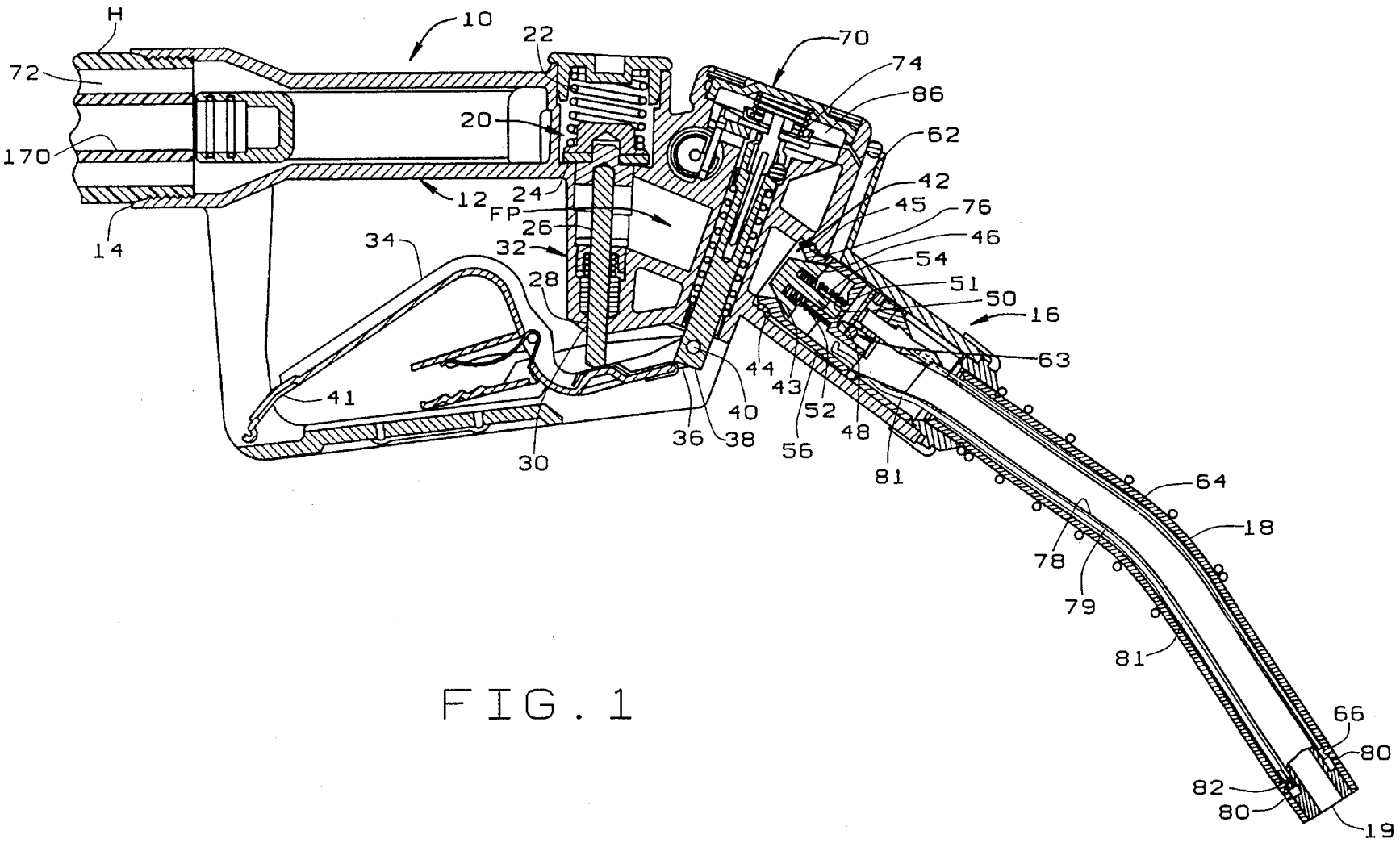
FIG. 1 is a cross-sectional view of a fuel dispensing nozzle incorporating the present invention.
Figure 2:
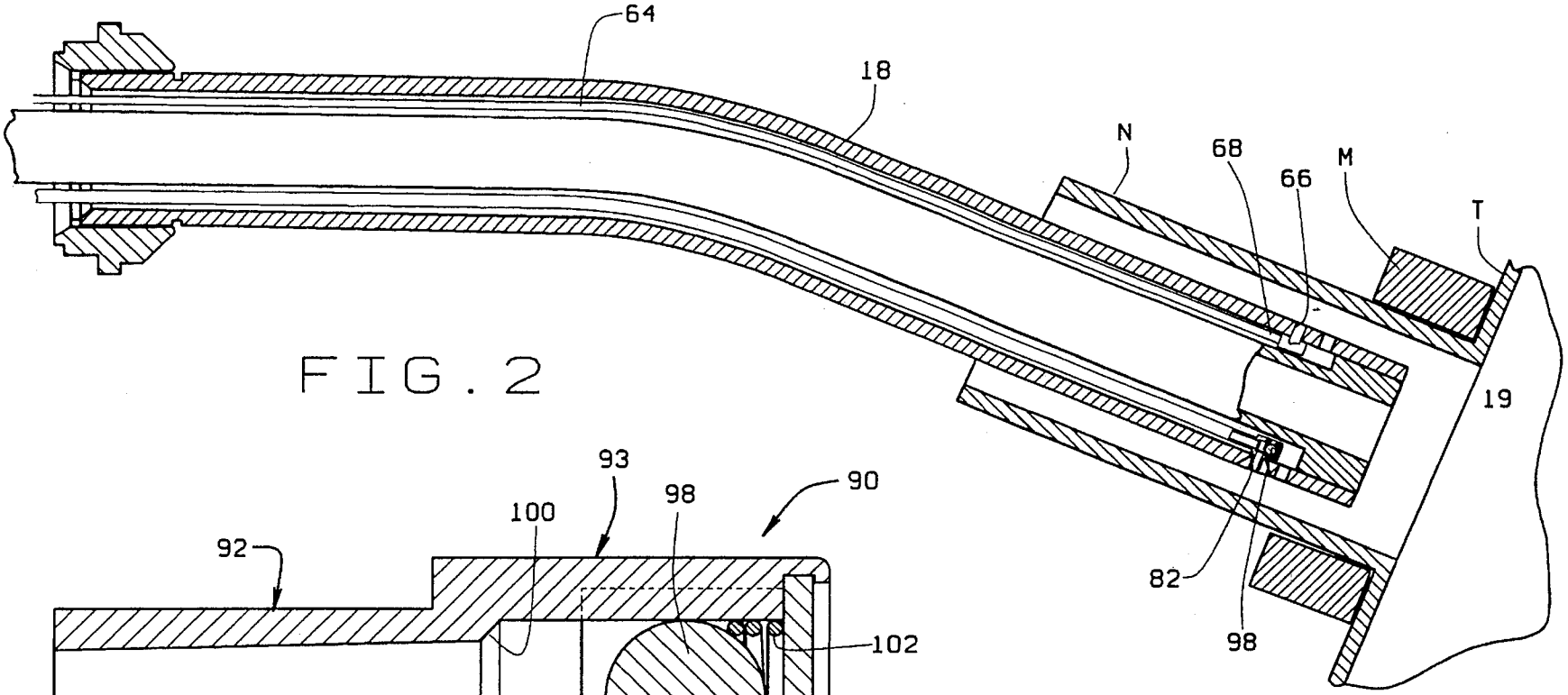
FIG. 2 is a cross-sectional view of a nozzle of the fuel dispensing nozzle inserted in the fill pipe of a vehicle's fuel tank.

Referring to the drawings, a nozzle for dispensing liquids such as gasoline, diesel fuel, or the like, is indicated generally at 10. The nozzle is preferably a vapor recovery nozzle, such as a vacuum assist type, as shown in FIG. 1. The nozzle includes a body 12 having an inlet 14 to which a fuel hose (not shown) is connected. The nozzle also has an outlet 16 communicating with a spout assembly 18. Assembly 18 has a mouth 19 which is insertable into the fill pipe N of an automobile fuel tank T (FIG. 2). The body inlet and outlet, and the spout define a fuel flow path FP through which fuel flows from a storage tank to the vehicles fuel tank. Disposed within body 12, between the inlet and outlet, is a poppet valve 20. This valve is biased by a spring 22 into sealing engagement with a poppet valve seat 24. Poppet 20 is secured to the upper end of a valve stem 26. The valve is located in the upper portion of body 12, and the valve stem extends downwardly through the body. The lower end of the stem projects through an opening 28 in the base 30 of a body section 32. An operating or hand lever 34 for the nozzle has one end 36, its pivoting functional end, connected to the lower end of an automatic shut-off plunger 38 by, for example, a pin 40, the other end 41 of the lever is grasped by the hand of a user, and when squeezed, the upward pressure on the lever forces the valve stem 26 upwardly. This moves valve 20 off valve seat 24, opening the valve, and permitting fuel flow through the nozzle. This is well known in the art.

Adjacent outlet 16 of the nozzle, in the flow path FP through body 12, is a variable venturi 42. A spring loaded check valve 43 is positioned in the venturi, on the downstream side thereof, to control fuel flow into the outlet, and to the spout. These are located at the proximate entrance 45 into the nozzle outlet 16. The check valve has a valve body 44 which is frustoconically shaped and fits into the flow restriction formed by the venturi. Extending from the underside 46 of the valve body is a valve stem 48. This stem is slidingly received in a cylindrically shaped valve guide 50 which projects inwardly into the outlet from an interior wall portion 51 of the spout assembly. An annular groove 52 is formed in an underside 46 of the valve body, adjacent stem 48, and extends upwardly into the valve body. The width of this groove is sufficient for a spring 54 to both fit into the groove and seat against the base thereof. Spring 54 also seats against the base of guide 50. When valve 20 is opened, the rush of fuel through the nozzle body unseats the check valve so fuel can flow through the venturi 42 to the nozzle spot and outlet. The flow rate is a function of the extent to which valve 43 is pushed downstream against the force of spring 54.

Venturi 42 is installed in a circular housing 56 which defines the outlet 16. When tank T is substantially full, it is desirable to terminate flow of fuel through the nozzle so to prevent overfilling the tank. An automatic shutoff assembly 70 is therefore provided. Shutoff assembly 70 is explained in detail in U.S. Pat. No. 5,197,523, which is incorporated herein by reference. The shutoff assembly 70 is controlled, in part, by a diaphragm assembly 74. A chamber 86 is defined above diaphragm assembly 74 which is connected to the venturi by an air passage 62. When fuel flows over the venturi 42, a partial vacuum is created that is communicated to chamber 86 via passage 62.

Turning to FIG. 2, a vent tube 64, defining part of and communicating with automatic shut-off means 70, is located in spout 18 and is in communication with air passage 62. The vent tube has a much smaller diameter than spout 18 and a length less than the spout. The vent tube thus terminates short of the mouth 19 of the spout. An opening air hole 66 is formed at the outer end of the spout adjacent its mouth, as is known. The outer end 68 of the vent tube is located adjacent this opening so air flowing into the spout through the opening flows through the vent tube. Because the vent tube is operatively connected to the air passage 62, by way of the attitude control mechanism 63, when the venturi creates a vacuum, air is drawn through the vent tube, dissipating the generated vacuum. As can be appreciated, this prevents a vacuum from building up in chamber 86, to prevent operation of the automatic shutoff. As described in the above noted patent, when the vent tube is closed, or sealed off, as by fuel from a fuel vehicle gas tank, the automatic shut-off system is operated, to effect closing of the poppet to prevent the further flow of fluid through the nozzle. This occurs because the passage 62 communicates with the venturi through the line 76, as noted.

This particular nozzle is of the vacuum assist type. Hence, the spout 18 is formed of concentric tubes, comprising the outer spout 18, as noted, and an inner disposed tube 78. Thus, fuel flows through the inner tube 78, after it bypasses the venturi 42. On the other hand, the space intermediate the inner tube 78, and the spout 18, generally shown as the space 79, through which vapors are accumulated and returned back through the nozzle to storage, after the vapors are drawn into the various circular arrayed intakes, as disclosed at 80, provided at the front portion of the spout 18.

Figure 3:
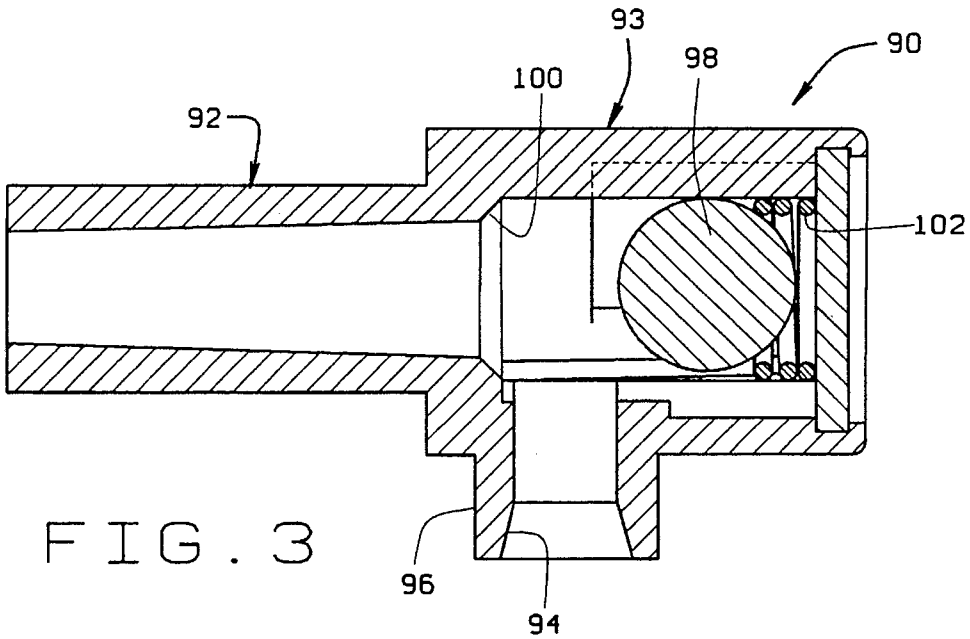
FIG. 3 is an enlarged view of a tip assembly which operates the automatic shut-off and prevents the flow of fuel through the nozzle.

Also provided at the lower segment between the spout 18, and the inner tube 78, is a further vent tube 81, and this vent tube at its front end is fitted with a cover or tip 90 (FIGS. 2 and 3). Tip 90 has a neck 92 which fits within the vent tube 81 to hold the tip to the vent tube and a body 93 into which the tip neck opens. The body has an opening 94 or port which is placed in communication with another air opening 82 provided in the spout. The port has a neck 96 which is received in the opening 82 so that the cap, and hence the vent tube 81, will be fixed in place within the spout.

The tip body defines a valve having a valve member or ball 98 movable within the body and a valve seat 100 defined by the junction of the tip neck and the tip body. The valve member 98 is preferably a magnetic ball. The ball is normally held in closure by the spring 102. This particular air line 81, normally receives air through the spout port 82, and this air is communicated back to the nozzle, for controlling the operations of a further diaphragm check valve, as to be subsequently explained.

Figure 4:
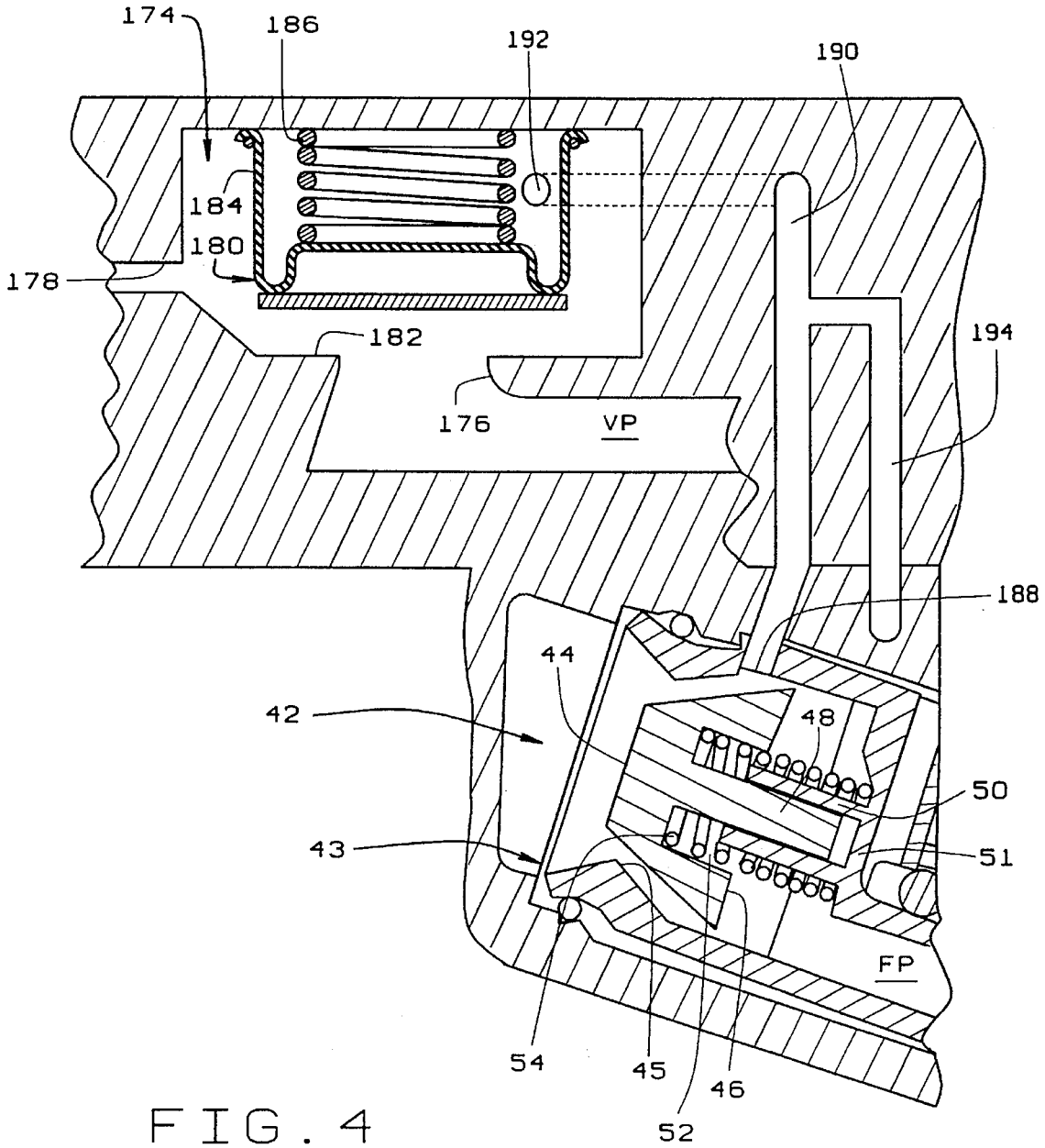
FIG. 4 is an enlarged cross-sectional, schematic drawing of the vapor recovery path shut off mechanism.

Turning to FIG. 4, the vapor flow path VP, providing for return and collection of vapors from the fuel tank during filling, and communicating with the spout 77 formed between the concentrically arranged spouts 18, continues back into the nozzle body 12, and into the hose. To prevent fuel vapors from escaping from the storage tank when the gas is not flowing through the nozzle, a valve 174 is placed in the vapor flow path to close the flow path VP. The valve could be located in the nozzle body, on its side, or at the vicinity of its extension 16. Valve 174 has an inlet 176, an outlet 178, and a valve element 180 which seats against a valve seat 182 to close the valve. The valve element includes a rolling diaphragm 184 which is biased closed by means of a spring 186. The passage 178 continues both through the nozzle, through a coaxial hose, as at H, and to the underground storage tank.

Valve 174 is also operated by a vacuum formed at venturi valve 43. Venturi body 44, at the entrance to the venturi as at 45, includes a port 188 across which fuel flows. A tube 190, or other path of communication, extends between port 188 and a control port 192 of valve 174. When fuel flows through venturi valve 42, gas flows over port 188, creating a venturi effect in tube 190. Under normal operation, the suction created by the venturi effect pulls diaphragm 184 off seat 182 to open vapor valve 174, as shown in FIG. 4. While the valve 174 is opened, the vapor flow path between the nozzle and the storage tank, due to the vacuum assist method, is open and fuel vapors may be returned to the storage tank. When the fuel tank is full, the automatic shut off system 70 employed by the nozzle assembly stops the flow of fuel through the nozzle assembly. The flow of gas over port 188 stops, and the venturi effect ceases. The suction in tube 190 therefore ceases and the spring 186 forces the valve closed. With the valve closed, fuel vapors cannot escape out the nozzle through the vapor flow path VP. Obviously, the tube 190 can be built into or located on the side of the nozzle's body as described to streamline the appearance of the nozzle.

To maintain the valve 174 closed when the nozzle is inserted in a vehicle having an on-board vapor recovery system, tube 190 is placed in communication with the vent tube 81 via a tube 194. The vent tubes, such as 190, may be integrally embodied within the structure of the nozzle in order to achieve this intercommunication. As can be appreciated, when the vent tube is opened, the control port will be opened to the atmosphere. The vacuum which is created by the venturi will therefore be diluted and broken and the spring 186 will hold the diaphragm 184 against seat 182 to maintain the valve 174 closed. The nozzle's vapor recovery will thus be turned off or disabled. When the vent tube 194 is closed, as when the nozzle is located for dispensing in a vehicle without on-board vapor recovery, the vacuum will not be-broken, and the valve 174 will operate as described above to recover fuel vapors and return them to the fuel storage tank.

Vehicles which include on-board vapor recovery systems may have a magnet M positioned around the neck of their fill pipes N (FIG. 2), in such a position that the magnetic field produced by the magnet will attract the valve member or ball 98 forwardly within its spout, to maintain the tip 90 in an opened condition. Thus, under these circumstances, the vent tube 81 remains opened, placing the tube 194 in communication with the atmosphere to break the vacuum created by the venturi, keep the valve 174 closed, to prevent the operaton of the nozzle's vapor recovery system. Without the use of such a magnet, the ball valve 98 may be attracted by the vacuum that is generated within the tube 81, as a result of the partial vacuum generated within the venturi 42, and thereby instantly close off the ball valve 98, to allow operation of the nozzle's vapor recovery system. In addition, it is likely that a spring, such as one shown at 102, could continuously bias the-ball valve 98 against its seat 100, to normally allow operation of the nozzle's vapor recovery system, until such time as a magnet is encountered, as the spout is inserted within the fill pipe N, to hold the ball forwardly, as shown in FIG. 3, to prevent operation of the nozzle's vapor recovery system. Thus, the magnetic ball is responsive to the presence or absence of a magnetic field to close the vent tube when the spout is placed in the tank of a vehicle having an on-board vapor recovery system. The magnet M may be a permanent magnet, or an electromagnet which is activated by a switch in the neck which is actuated by the insertion of the nozzle spout into the tank fill pipe. On the other hand, a permanent magnet will likely work without necessitating the presence of any electrical means in conjunction with the dispensing of volatile fuels. As can be appreciated, vehicles which do not have an on-board recovery system will not be equipped with such a magnet, and therefore, the valve member or ball 98 will either be spring biased into closure, thereby allowing operation of the nozzle's vapor recovery system.

Obviously, the nozzle can also be configured so that the magnetic field is produced by a vehicle which does not have an on-board vapor recovery system. The magnetic ball and the magnetic field would be of the same polarity so that the magnetic field repels the ball. The repelling force of the magnets would cause the ball to seat against the tip valve seat, closing off the vent, and allowing operation of the nozzle's vapor recovery system. This is just an example of an alternative.

As can be appreciated, a vacuum type nozzle is disclosed which can indirectly determine when a vehicle has an on-board vapor recovery system. When the nozzle detects that the vehicle has an on-board recovery system, it opens the nozzle tip valve, to prevent operation of its own vapor recovery system.

Variations within the scope of the appended claims may be apparent to those skilled in the art. The foregoing description is thus illustrative only, and is not intended to be limiting.

Having thus described the invention, what is claimed and desired to be secured by Letters Patent is:

1. In a nozzle assembly for dispensing fuel from a source to a fuel tank, the nozzle assembly comprising:

a nozzle body defining a body fuel flow path and a body vapor recovery path;

a spout connected to said body and defining a spout fuel flow path and a spout vapor recovery path, said spout fuel flow path being in fluid communication with said body fuel flow path and said spout vapor recovery path being in fluid communication with said body vapor recovery path, said spout including a vent tube operatively associated with said vapor recovery flow path, said vent tube having a tip valve therein operable to open and close said vent tube;

a venturi valve positioned in said body fuel flow path, said venturi valve having a valve body, a valve seat, and a valve member, said valve member being movable between a first position in which it seats against said valve seat to close said venturi valve and a second position in which said venturi valve is opened, said valve member being biased to normally close said venturi valve, said venturi valve being opened by pressure from fuel flowing through said fuel flow path, said venturi valve being closed when fuel flow through said fuel flow path ceases, said venturi valve having a venturi control port;

a diaphragm valve positioned within said body vapor recovery flow path, said diaphragm valve being movable between a first position in which said vapor recovery flow path is closed and a second position in which said vapor recovery flow path is opened, said diaphragm valve being normally biased to said first, closed position, said diaphragm valve including a control section having a control port;

said venturi control port being in communication with said fuel flow path, operable when subject to venturi action, to move said diaphragm valve between said closed and opened positions, a venturi vacuum line being defined by a path of communication extending between said diaphragm valve control port and said venturi control port in said fuel flow path, said venturi creating a vacuum in said path of communication sufficiently strong to move said diaphragm from said closed position to said opened position to allow the recovery of vapors;

said diaphragm valve control port and vacuum line being in communication with said vent tube to place said diaphragm control section in communication with the atmosphere when said tip valve is opened, wherein when said tip valve is operated to place said diaphragm control port in communication with said atmosphere, said diaphragm valve is biased closed to prevent vapor recovery through the nozzle.

2. The nozzle of claim 1 wherein said diaphragm valve includes a spring in said control section to normally bias said diaphragm valve closed to prevent the escape of recovered vapors.

3. The nozzle of claim 1 wherein said tip valve is positioned in said nozzle, said tip valve including a valve body having a port in communication with said diaphragm control section and a port in communication with the atmosphere, a valve seat, and a magnetic sensitive valve member sized to close one of said tip valve ports to close said vent tube, said magnetic sensitive valve member being responsive to the presence of a magnetic field and close said tip valve to control the functioning of said vapor recovery system.

4. In combination, a fuel dispensing nozzle and a vehicle having a fuel tank;

the fuel tank having a fill pipe with a neck portion and with a magnet surrounding at least a part of said neck portion;

said fuel dispensing nozzle being a vacuum assist nozzle which creates a vacuum when fuel flows through the nozzle and having a spout which is received in the fuel tank neck and be influenced by said magnet, an air port at a distal end of said spout, a vent tube extending through said spout and having an end in communication with said air port, said vacuum created by said nozzle drawing air through said vent tube, and a vapor recovery system for returning fuel vapors to a fuel storage tank along a vapor recovery flow path; said vapor recovery system including a valve which is operable to open and close said vapor recovery flow path, said vapor recovery valve being responsive to the passage of air through said vent tube; and detection means responsive to the presence of said magnet in said neck portion to maintain said vapor recovery valve in a desired one of said open or closed positions to prevent the operation of said nozzle vapor recovery system when said vehicle includes an on-board vapor recovery system.

5. The combination of claim 4 wherein said detection means includes a valve in said vent tube, said valve including a valve body and a magnetic valve member, said valve being positioned in said spout so that it is influenced by the magnetic field of said fuel tank magnet.

6. The combination of claim 5 wherein said vehicle is a vehicle with an on-board vapor recovery system, said valve being normally biased closed by said vacuum, said vacuum seating said magnetic valve member against said valve body to close said vent tube to normally allow operation of said dispensing nozzle vapor recovery system, said fuel tank neck magnet attracting and unseating said magnetic valve member to prevent operation of said nozzle vapor recovery system.

7. The combination of claim 6 wherein said vapor recovery valve is a diaphragm valve having a control section, said control section being in communication with said venturi, said diaphragm valve being responsive to a vacuum created by said venturi to open said diaphragm valve and allow operation of said nozzle vapor recovery system; said control section also being in communication with said vent tube and responsive to the position of said tip valve member, wherein when said tip valve is opened, said control section is in communication with the atmosphere to close said diaphragm valve independent of the presence of said venturi vacuum.

8. The combination of claim 5 wherein said vehicle is a vehicle with an on-board vapor recovery system, said valve including a spring which normally biases said valve closed, said spring seating said magnetic valve member against said valve body to close said vent tube to normally allow operation of said nozzle vapor recovery system during fuel dispensing, said fuel tank neck magnet attracting and unseating said magnetic valve member to prevent operation of said nozzle vapor recovery system, while the vehicle on-board vapor recovery system functions.

9. The combination of claim 5 wherein said vehicle is a vehicle without an on-board vapor recovery system, said magnetic valve member and said fuel tank magnet being of the same polarity, said fuel tank magnet repelling said valve member to seat said valve member to close said vent tube to allow operation of said nozzle vapor recovery system.

* * * * *

UNITED STATES PATENT AND TRADEMARK OFFICE

CERTIFICATE OF CORRECTION

PATENT NO. : 5,562,133

DATED : October 8, 1996

INVENTOR(S) : Thomas O. Mitchell

It is certified that error appears in the above-indentified patent and that said Letters Patent is hereby corrected as shown below:

Title page, item [73],
Please change name of Assignee, from "Hiesky Corporation" to ---Husky Corporation---.

Signed and Sealed this

Third Day of June, 1997

*Attest:*

*Attesting Officer*

BRUCE LEHMAN

*Commissioner of Patents and Trademarks*